US010948264B1

(12) United States Patent
Brumfield et al.

(10) Patent No.: US 10,948,264 B1
(45) Date of Patent: Mar. 16, 2021

(54) DUAL-EMITTER MICRO-DOT SIGHT

(71) Applicant: Sig Sauer, Inc., Newington, NH (US)

(72) Inventors: Richard Bradley Brumfield, Athens, AL (US); Brandon Schmidt, Beavercreek, OR (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 16/684,486

(22) Filed: Nov. 14, 2019

(51) Int. Cl.
*F41G 1/30* (2006.01)
*F41G 1/34* (2006.01)
*F41G 1/17* (2006.01)
*F41G 1/14* (2006.01)

(52) U.S. Cl.
CPC ..... *F41G 1/34* (2013.01); *F41G 1/14* (2013.01); *F41G 1/17* (2013.01); *F41G 1/30* (2013.01)

(58) Field of Classification Search
CPC ..... F41G 1/14; F41G 1/17; F41G 1/30; F41G 1/34; F41G 1/345
USPC ..... 42/111, 113, 115, 130, 131, 120, 132
See application file for complete search history.

(56) References Cited

U.S. PATENT DOCUMENTS 5,483,362 A * 1/1996 Tai ..... F41G 1/30 359/1
5,815,936 A * 10/1998 Sieczka ..... G03H 1/0005 42/115
7,796,329 B2 * 9/2010 Dobschal ..... F41G 1/30 359/399
8,934,159 B2 * 1/2015 Shikii ..... G02B 27/01 359/3
9,423,212 B2 * 8/2016 Campean ..... F41G 1/02
10,234,238 B1 * 3/2019 Thomas ..... F41G 1/30
2005/0057808 A1 * 3/2005 Houde-Walter ..... F41G 3/065 359/566
2006/0164704 A1 * 7/2006 Sieczka ..... F41G 1/30 359/15
2009/0051989 A1 * 2/2009 Dobschal ..... F41G 1/30 359/15
2012/0091347 A1 * 4/2012 Houde-Walter ..... H04N 5/33 250/349
2014/0075820 A1 * 3/2014 Ben-Ami ..... F41G 1/345 42/123
2015/0198415 A1 * 7/2015 Campean ..... F41G 1/30 42/137
2016/0231083 A1 * 8/2016 Regan ..... F41G 3/06
(Continued)

*Primary Examiner* — Jonathan C Weber
(74) *Attorney, Agent, or Firm* — Miller Nash Graham & Dunn LLP

(57) ABSTRACT

A dual-emitter micro-dot sight comprising a sight housing configured to mount to a shooting device, a first and a second light emitter each coupled to the sight housing, a beam combiner, a collimating lens, and a diverging lens. The beam combiner is configured to receive light from each of the first and the second light emitters and to guide the light to an optical path. The collimating lens is in the optical path and is configured to collimate the light from each of the first and the second light emitters. The diverging lens is in the optical path between the beam combiner and the collimating lens, and the diverging lens is configured to spread the light from each of the first and the second light emitters. The dual-emitter micro-dot sight may include windage and elevation adjustment mechanisms that are separate and independent for each of the first and the second light emitters.

31 Claims, 9 Drawing Sheets

(56) References Cited

U.S. PATENT DOCUMENTS

| | | | | |
|---|---|---|---|---|
| 2018/0128574 | A1* | 5/2018 | Crispin | F41G 1/30 |
| 2019/0383578 | A1* | 12/2019 | Mills | F41G 1/30 |

* cited by examiner

DUAL-EMITTER MICRO-DOT SIGHT

TECHNICAL FIELD

The subject matter is related to systems and methods for providing target acquisition information within a sight for a shooting device.

BACKGROUND

Conventional micro-dot sights project a dot of light onto a sight window. The user looks through the sight window to aim the shooting device by positioning the shooting device so that the dot of light, which is visible on the sight window, appears to overlay the desired target. Embodiments of the disclosed technology address shortcomings in the prior art.

DETAILED DESCRIPTION

As described herein, embodiments are directed to a dual-emitter micro-dot sight.

Micro-dot sights project a dot of light onto a sight window, the dot of light being often referred to as the hold-over point. The user looks through the sight window, along a line of sight, to aim the shooting device. Specifically, the user positions the shooting device so that the hold-over point, which is visible on the sight window, appears to overlay the desired impact point on the target. Hence, the hold-over point visually indicates to the shooter-based on the current elevation and windage settings of the sight—where to aim the shooting device to strike the intended target.

The dual-emitter micro-dot sight described here has the ability to display multiple hold-over points on the sight window, and each hold-over point is independent. To accomplish those benefits, embodiments of the disclosed technology utilize separate emitters, windage adjustment mechanisms, and elevation adjustment mechanisms for each resulting hold-over point, all within the same device.

Therefore, and as one example, one hold-over point could be calibrated, or zeroed-in, for a subsonic projectile and another hold-over point could be zeroed-in for a supersonic projectile. As another example, one hold-over point could be zeroed-in for a first range (such as 25 yards) and another hold-over point could be zeroed-in for another range (such as 100 yards). In embodiments, buttons or other user input devices on the dual-emitter micro-dot sight allow the user to select whether to display one or both of the hold-over points.

In addition, embodiments of the disclosed technology prevent substantially all of the light from the emitters from being visible downrange. To accomplish this benefit, embodiments of the disclosed technology utilize a substantially flat, front sight window that reflects the light from the emitters to the user's eye and refracts the unreflected portion of the light into another portion of the dual-emitter micro-dot sight, such as a shroud, or hood, configured to absorb substantially all of that refracted light. Curved sight windows, by contrast, tend to allow a significant amount of light to be visible from downrange.

Figure 1:
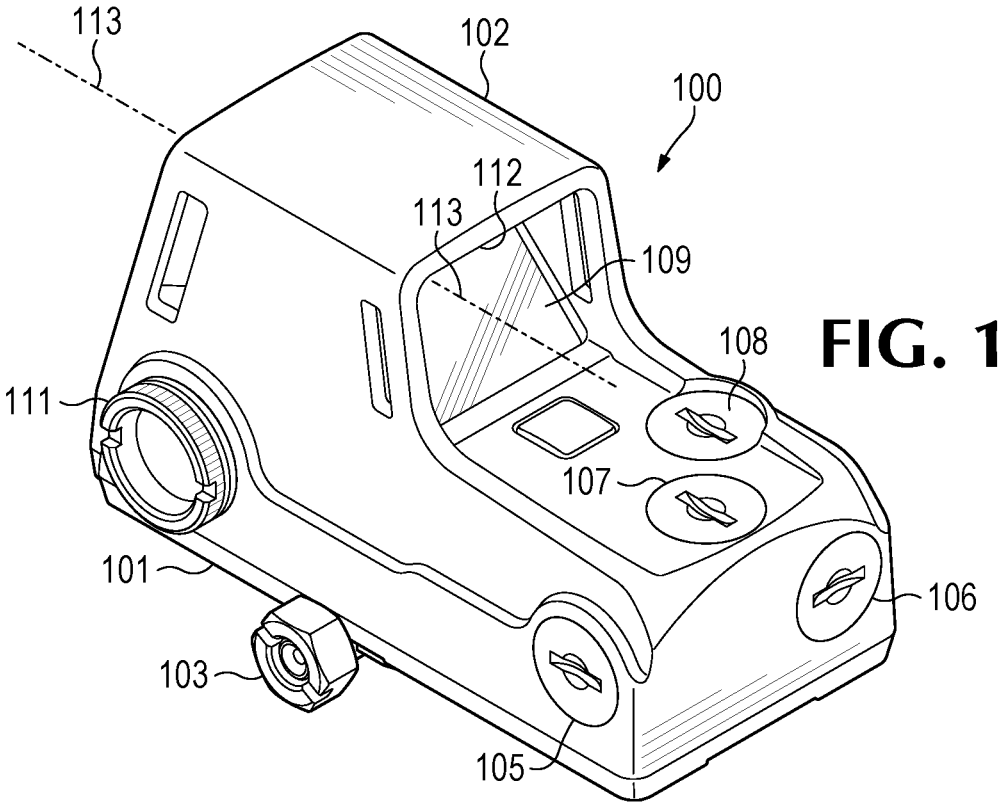
FIG. 1 is a top perspective view of a dual-emitter micro-dot sight, according to embodiments.
Figure 2:
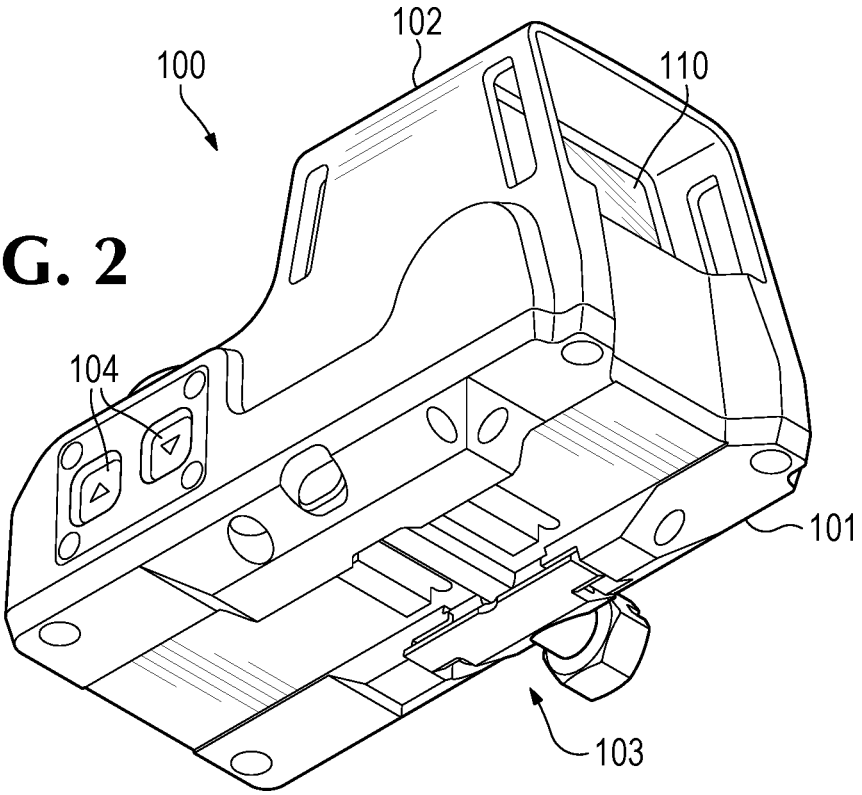
FIG. 2 is a bottom perspective view of the dual-emitter micro-dot sight of FIG. 1.

FIG. 1 is a top perspective view showing portions of a dual-emitter micro-dot sight, according to embodiments. FIG. 2 is a bottom perspective view of the dual-emitter micro-dot sight of FIG. 1. As illustrated in FIGS. 1 and 2, a dual-emitter micro-dot sight 100 may include a sight housing 101, a protective cover 102, a mount interface 103, adjustment inputs 104, a first user-adjustable windage dial105, a second user-adjustable windage dial 106, a first user-adjustable elevation dial 107, a second user-adjustable elevation dial 108, a front sight window 109, a rear sight window 110, a utility cover 11, and a shroud 112.

In use, the user looks through the rear sight window 110 toward the front sight window109, defining a line of sight 113, with the desired target being visible beyond (and through) the front sight window 109. As described further below, one or more hold-over points 114, 115 may be visible to the user when looking along the line of sight 113.

Figure 8:
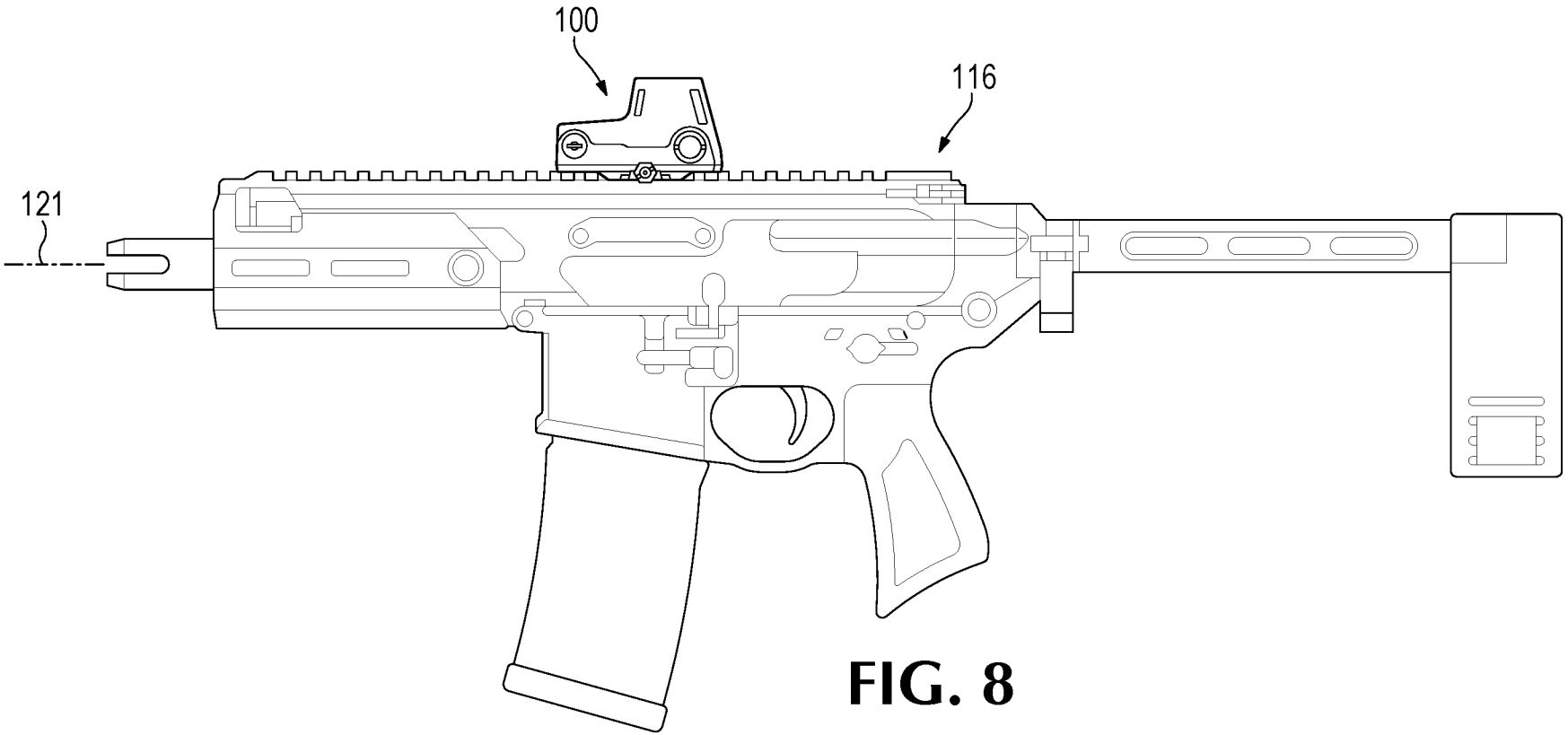
FIG. 8 is a side view of the dual-emitter micro-dot sight of FIG. 1 mounted to an example shooting device.

The sight housing 101 may be configured to mount to a shooting device, such as the example shooting device 116 of FIG. 8. The mount interface 103 may be configured to mount the dual-emitter micro-dot sight 100 to the shooting device. The mount interface 103 may be, for example, a quick-disconnect mount or other known mechanism for mounting sights to shooting devices, including using bolts with hex or star drive patterns.

Figure 5A:
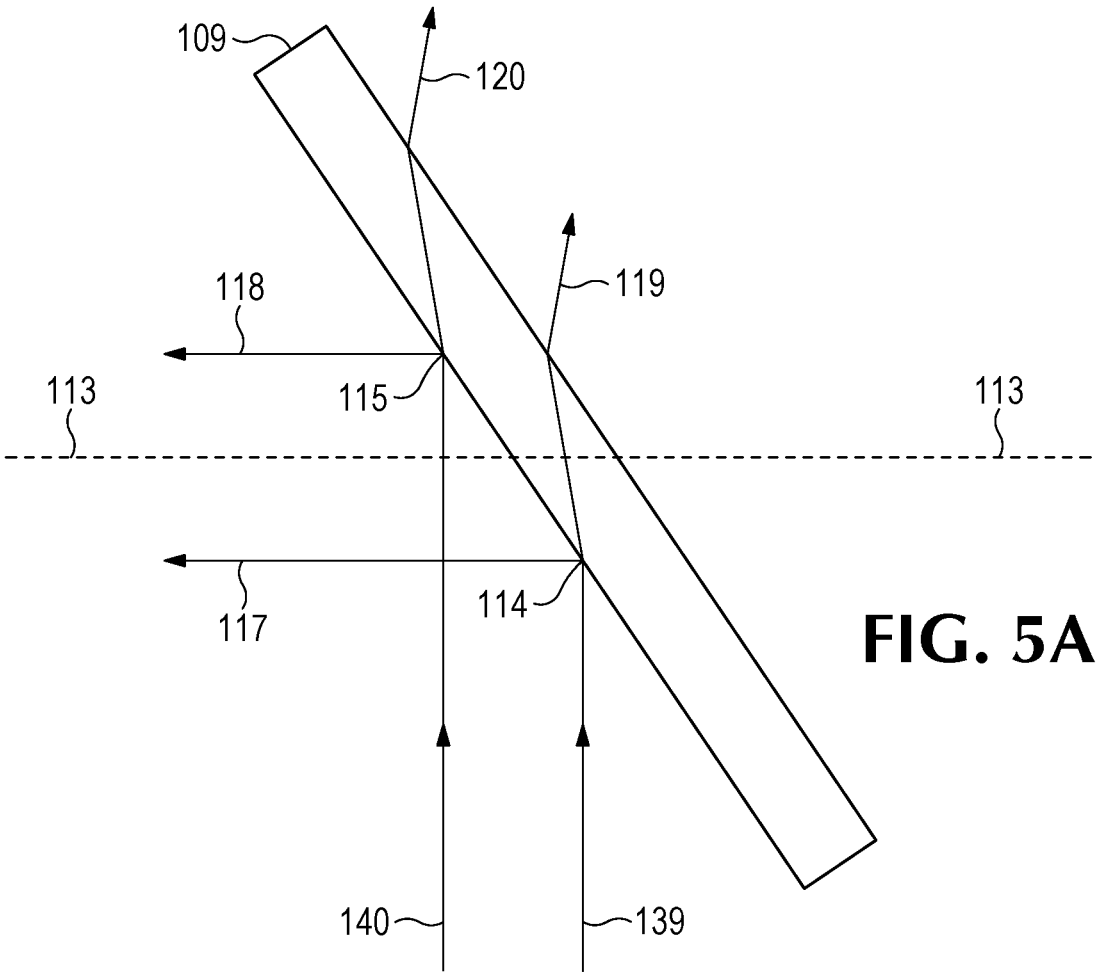
FIG. 5A is aside view of the front sight window of FIG. 4.

The shroud 112 may be configured to absorb substantially all of a second portion 119 of the light from the first light emitter 122 (illustrated in FIG. 5A) and the second portion 120 of the light from the second light emitter 123 (also illustrated in FIG. 5A). The shroud 112 may be, for example, an extension of or coupled to the protective cover 102. As another example, the shroud 112 may be an extension of or coupled to the lens housing 141 (illustrated in FIG. 3). The protective cover 102, together with the sight housing 101, the front sight window 109, and the rear sight window 110, may be configured to protect the interior components and surfaces of the dual-emitter micro-dot sight 100 from debris or moisture or both.

The adjustment inputs 104 may be configured as, for example, up-down or right-left pushbuttons to move sequentially through multiple available settings. The settings could be, as examples, night vision or visible settings. As a non-limiting example, the adjustment inputs 104 may be configured to move sequentially through twelve available settings, including two night vision settings and ten visible settings. The different settings may have, for example, different brightness values or dot sizes or both. As another example, the adjustment inputs 104 may instead or also be configured to toggle between a supersonic mode displaying a supersonic hold-over point, a subsonic mode displaying a subsonic hold-over point, or a simultaneous mode displaying both the supersonic hold-over point and the subsonic hold-over point. Hence, the dual-emitter micro-dot sight 100 may include a controller coupled to the adjustment inputs 104 and configured to implement the functions of the adjustment inputs 104.

As also explained in patent application publications US 20190128643 and US 20190186871, ballistic trajectory is a parabolic curve that begins its initial ascent at the angle of the bore line of the shooting device. An example bore line 121 of the shooting device 116 is illustrated in FIG. 8. Due to gravitational forces, a projectile fired from the shooting device may undergo a certain amount of vertical bullet drop relative to the bore line along the path of the projectile. The ballistic trajectory for the projectile may also vary with environmental conditions, such as crosswind, pressure, temperature, density altitude, humidity, and angle of incline as well as with the projectile's characteristics, such as caliber, bullet weight, ballistic coefficient, and muzzle velocity.

Through a zeroing-in process, a sight, such as the dual-emitter micro-dot sight 100, may be locked into a position relative to the bore line of the shooting device. Zeroing-in typically includes shooting a fixed target from a known range (for example, 100 yards) and adjusting the position of a reticle within the sight (for typical riflescopes) or the position of the emitter (for emitter-type sights) relative to the bore line until the central aiming point of the reticle within the riflescope or the dot from the emitter appears to the shooter to coincide with the actual point of impact on the target. These adjustments may be made in both the horizontal and vertical directions, using a windage adjustment and an elevation adjustment, respectively. Here, horizontal and vertical are relative to the typical shooting position where the bore line of the shooting device is substantially tangential to the earth's surface at the location of the shooting device. As used in this disclosure, "substantially tangential" means largely or essentially tangential, without requiring perfect tangentiality.

For targets at ranges and under environmental conditions that are different from the zeroed-in range and conditions, the shooter may need to compensate for the different range and conditions by, for example, utilizing an electronic ballistics calculator.

That is, for given range, environmental conditions, selected projectile, and other user input information, the electronic ballistics calculator may compute a new ballistic profile for the selected projectile. The electronic ballistics calculator may, for example, use stored drag curves, empirically measured data tables, or algorithms for the selected projectile to calculate the amount of vertical bullet drop at any range. The amount of vertical bullet drop may be used to determine an elevation correction—the amount that the hold-over point should be moved up or down—to compensate for the vertical bullet drop. The ballistic profile may include a windage correction—the amount that the hold-over point should be moved left or right—to compensate for any component of the wind that is perpendicular to the intended path of the projectile.

The first user-adjustable windage dial 105 may be configured to adjust the position of the first light emitter 122 relative to a beam combiner 124 (illustrated in FIG. 4) to effect a windage adjustment of the first light emitter 122. Hence, actuating the first user-adjustable windage dial 105 may cause the light from the first light emitter 122, at a point 114 where the light strikes the front sight window 109 (that is, the hold-over point for the first light emitter 122), to be adjusted horizontally left or right. The second user-adjustable windage dial 106 may be configured to adjust the position of the second light emitter 123 relative to the beam combiner 124 to effect a windage adjustment of the second light emitter 123. Hence, actuating the second user-adjustable windage dial 106 may cause the light from the second light emitter 123, at the point 115 where the light strikes the front sight window 109 (that is, the hold-over point for the second light emitter 123), to be adjusted horizontally left or right. The windage adjustment feature is described in further detail for FIGS. 3-7 below.

The first user-adjustable elevation dial 107 may be configured to adjust the position of the first light emitter 122 relative to a beam combiner 124 (illustrated in FIG. 3) to effect an elevation adjustment of the first light emitter 122. Hence, actuating the first user-adjustable elevation dial 107 may cause the light from the first light emitter 122, at a point 114 where the light strikes the front sight window 109 (that is, the hold-over point for the first light emitter 122), to be adjusted up or down vertically. The second user-adjustable elevation dial 108 may be configured to adjust the position of the second light emitter 123 relative to the beam combiner 124 to effect an elevation adjustment of the second light emitter 123. Hence, actuating the second user-adjustable elevation dial 108 may cause the light from the second light emitter 123, at a point 115 where the light strikes the front sight window 109 (that is, the hold-over point for the second light emitter 123), to be adjusted up or down vertically. The elevation adjustment feature is described in further detail for FIGS. 3-7 below.

The utility cover 111 provides access to a chamber behind the utility cover 111 that may house, for example, a battery to provide power to the dual-emitter micro-dot sight 100.

The front sight window 109, the rear sight window 110, and the other features illustrated in FIGS. 1 and 2 are further described in the discussion that follows.

Figure 3:
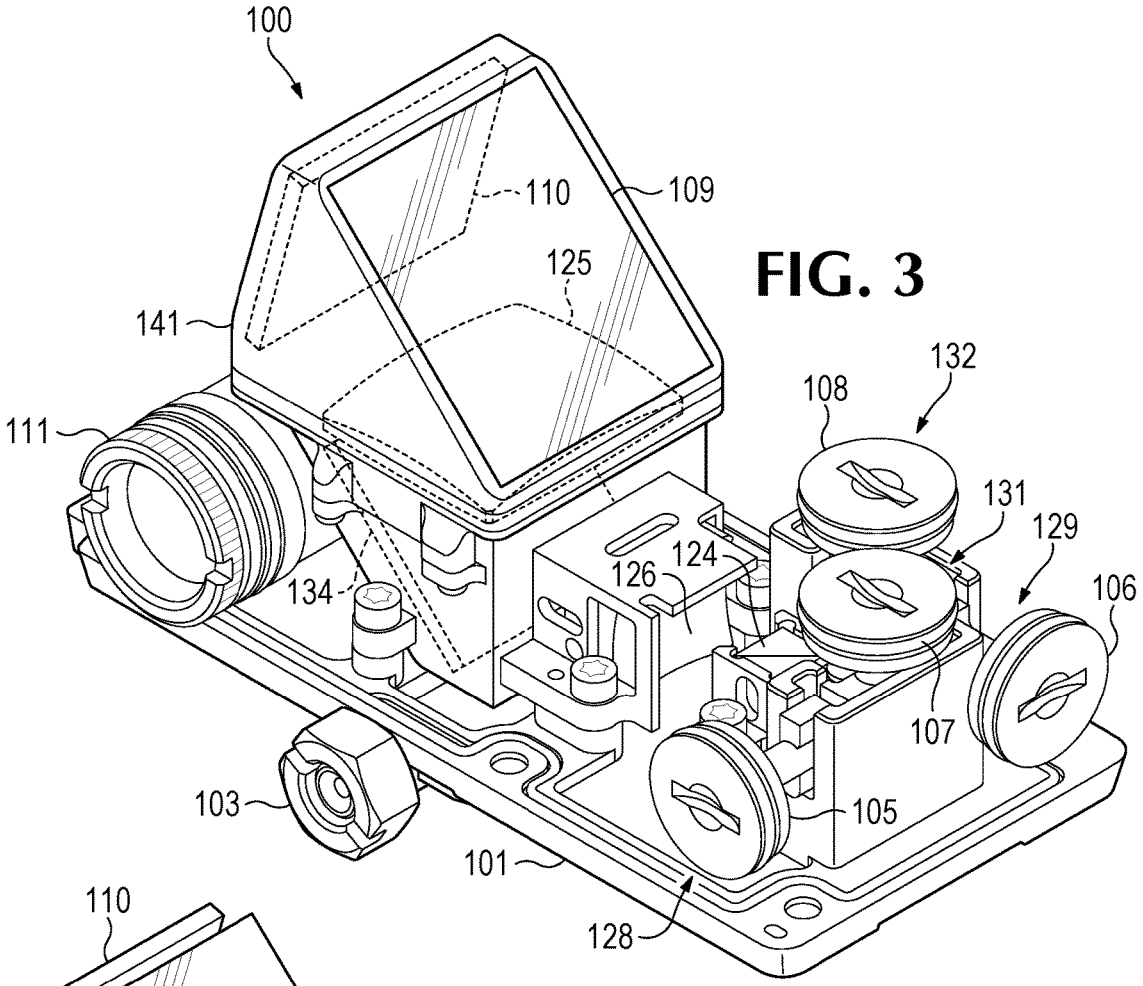
FIG. 3 is a top perspective view of the dual-emitter micro-dot sight of FIG. 1, with the protective cover removed to show other details.

FIG. 3 is a top perspective view of the dual-emitter micro-dot sight 100 of FIG. 1, with the protective cover 102 removed to show other details. As illustrated in FIG. 3, the dual-emitter micro-dot sight 100 may include the sight housing 10, the mount interface 103, the first user-adjustable windage dial 105, the second user-adjustable windage dial106, the first user-adjustable elevation dial107, the second user-adjustable elevation dial 108, the front sight window 109, and the rear sight window 110, each as described above for FIGS. 1-2. The dual-emitter micro-dot sight 100 may also include a beam combiner 124, a collimating lens 125, a windage adjustment mechanism 128 for the first light emitter 122, a windage adjustment mechanism 129 for the second light emitter 123, an elevation adjustment mechanism 131 for the first light emitter 122, an elevation adjustment mechanism 132 for the second light emitter 123, a mirrored surface 134, and a lens housing 141.

The lens housing 141 may be configured to secure the front sight window 109 and the rear sight window 110 and to prevent light from the first light emitter 122 and the second light emitter 123 (each illustrated in FIG. 4) from exiting the lens housing 141 other than through the front sight window 109 and the rear sight window 110.

The beam combiner 124, the collimating lens 125, and the mirrored surface 134 are described in more detail below for FIG. 4. The windage adjustment mechanism 128 for the first light emitter 122, the windage adjustment mechanism 129 for the second light emitter 123, the elevation adjustment mechanism 131 for the first light emitter 122, and the elevation adjustment mechanism 132 for the second light emitter 123 are described in more detail below for FIGS. 6-7.

Figure 4:
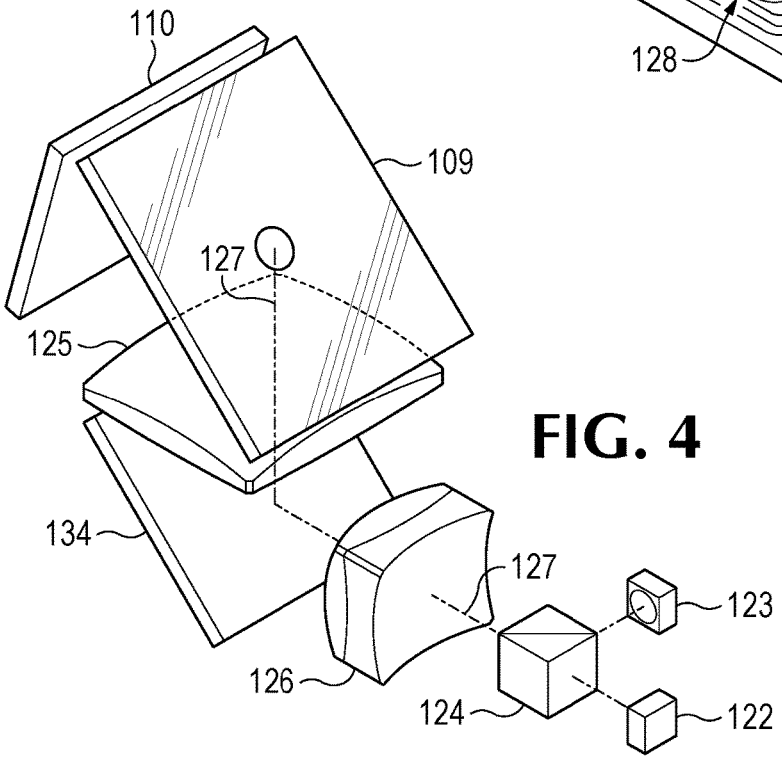
FIG. 4 is a top perspective view of the dual-emitter micro-dot sight of FIG. 1, showing only certain optical elements.
Figure 5B:
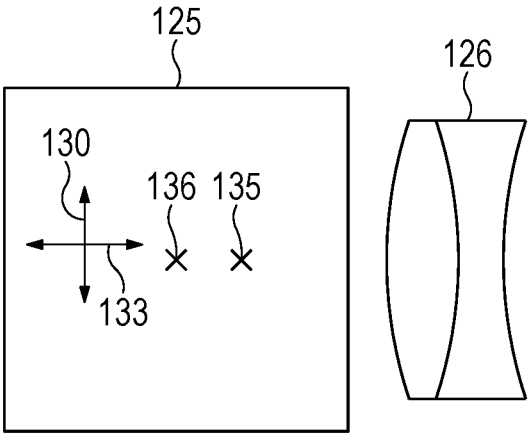
FIG. 5B is a top view of the collimating lens of FIG. 4.

FIG. 4 is a top perspective view of the dual-emitter micro-dot sight 100 of FIG. 1, showing only certain optical elements. FIG. 5A is a side view of the front sight window109 of FIG. 4. FIG. 5B is a top view of the collimating lens of FIG. 4. As illustrated in FIGS. 4-5B, the dual-emitter micro-dot sight 100 may include the first light emitter 122, the second light emitter 123, the beam combiner 124, the diverging lens 126, the mirrored surface 134, the collimating lens 125, the rear sight window 110, and the front sight window 109.

Each of the first light emitter 122 and the second light emitter 123 may be coupled to the sight housing 101 (illustrated in FIG. 3). Each of the first light emitter 122 and the second light emitter 123 may be, for example, an LED (light-emitting diode), an OLED (organic light-emitting diode), a multi-pixel array, or another light source. In the configuration shown in FIG. 4, the first light emitter 122 and the second light emitter 123 each ultimately produce a dot of light, or hold-over point, on the front sight window 109, as explained more fully below. In embodiments, the first light emitter 122 may, for example, emit light that appears to be red. In embodiments, the second light emitter 123 may, for example, emit light that appears to be green.

The beam combiner 124 may be configured to receive light from the first light emitter 122 and to guide the light from the first light emitter 122 to an optical path 127. The beam combiner 124 may also be configured to receive light from the second light emitter 123 and to guide the light from the second light emitter 123 to the optical path 127. As a non-limiting example, the beam combiner 124 may be a cube beam combiner 124. As another non-limiting example, the beam combiner 124 may be coated window or plate that is at an angle, such as forty-five degrees, to the light coming from the first light emitter 122 or the light coming from the second light emitter 123, or both. As another non-limiting example, the beam combiner 124 may be a pellicle beam combiner.

The collimating lens 125 is in the optical path 127. The collimating lens 125 is configured to collimate the light from the first light emitter 122 and to collimate the light from the second light emitter 123. The light from the first light emitter 122 may strike the collimating lens 125 at a first location 135, and the light from the second light emitter 123 may strike the collimating lens 125 at a second location 136. The first location 135 and the second location 136 are used as reference points for the discussion about windage and elevation adjustments. Depending on the windage and elevation settings of each of the first light emitter 122 and the second light emitter 123, the first location 135 may be spatially separated from the second location 136. Or the first location 135 may coincide with the second location 136. In embodiments, the first location 135 does not depend on the second location 136, and the second location 136 does not depend on the first location 135. In such embodiments, one of the first location 135 or the second location 136 can be located or adjusted without locating or adjusting the other of the first location 135 or the second location 136.

The diverging lens 126, or negative lens, is in the optical path 127. The diverging lens 126 may be, for example, between the beam combiner 124 and the collimating lens 125. The diverging lens 126 is configured to spread the light from the first light emitter 122, causing it to substantially fill the collimating lens 125. The diverging lens 126 is configured to spread the light from the second light emitter 123, causing it to substantially fill the collimating lens 125. As used in this disclosure, "to substantially fill" means to largely or essentially pervade without requiring perfect pervasiveness.

The substantially flat, mirrored surface 134, when present, is in the optical path 127. The mirrored surface 134 is configured to reflect the light from the first light emitter 122 and the light from the second light emitter 123. For example, as illustrated in FIG. 4, the mirrored surface 134 may be configured to reflect the light from the first light emitter 122 and the light from the second light emitter 123 as the light passes from the diverging lens 126 to the collimating lens 125. As used in this disclosure, "substantially flat" means largely or essentially flat without requiring perfect flatness. Hence, as used in this disclosure, a "substantially flat" surface would exclude surfaces that are spherical or curved.

The substantially flat, front sight window 109, when present, is in the optical path 127. As an example, the collimating lens 125 may be between the diverging lens 126 and the front sight window 109 in the optical path 127. With particular reference to FIG. 5A, the front sight window 109 may be configured to reflect a first portion 117 of the light 139 from the first light emitter 122 along a line of sight 113 and to reflect a first portion 118 of the light 140 from the second light emitter 123 along the line of sight 113. The front sight window 109 may also be configured to refract a second portion 119 of the light 139 from the first light emitter 122 and a second portion 120 of the light 140 from the second light emitter 123 through the front sight window 109 and diverging from the line of sight 113.

As noted above, the shroud 112 (illustrated in FIG. 1), when present, may be configured to absorb substantially all of the second portion 119 of the light from the first light emitter 122 and the second portion 120 of the light from the second light emitter 123. Hence, the shroud 112 may overhang the front sight window 109, for example as shown in FIG. 1.

The substantially flat, rear sight window 110, when present, may be configured to permit the first portion 117 of the light from the first light emitter 122 to pass through the rear sight window 110 along the line of sight 113, and to permit the first portion 118 of the light from the second light emitter 123 to pass through the rear sight window 110 along the line of sight 113.

Figure 6:
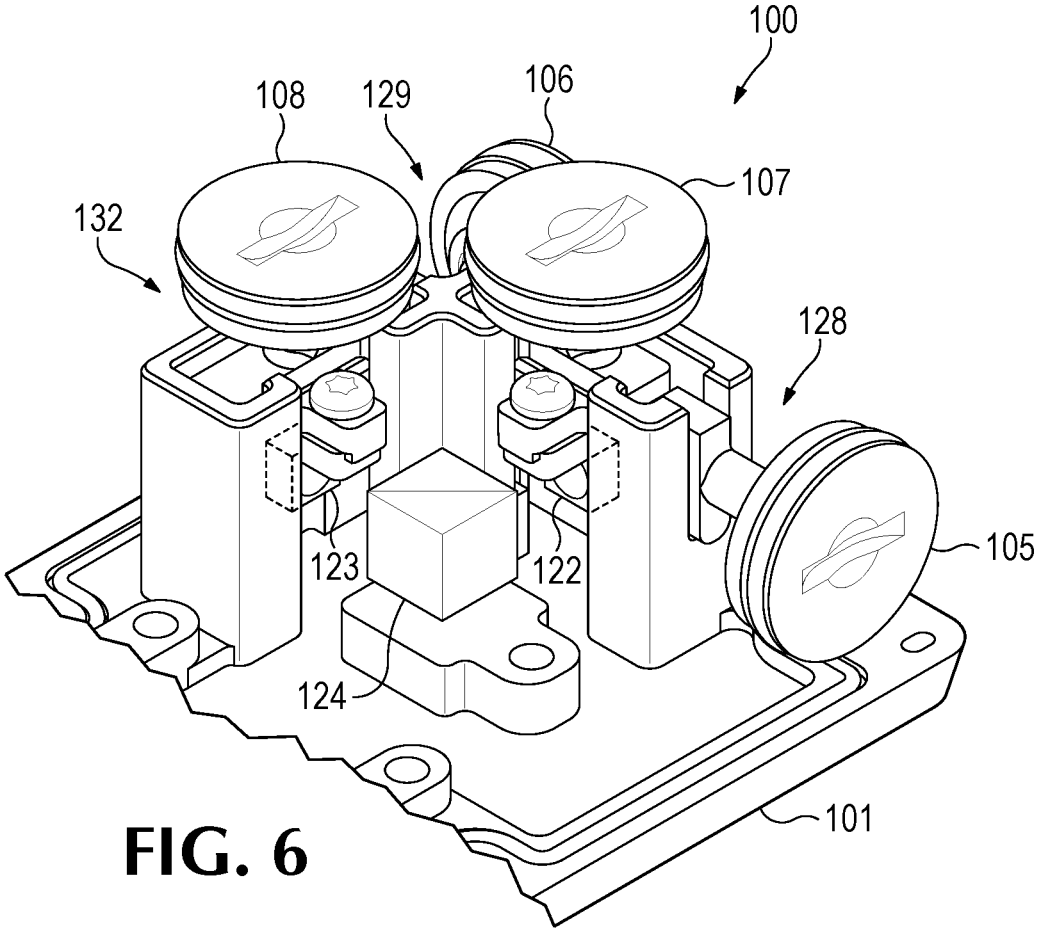
FIG. 6 is a top, reverse-angle perspective view of a portion of the dual-emitter micro-dot sight of FIG. 3, where some elements have been removed to show other details.
Figure 7:
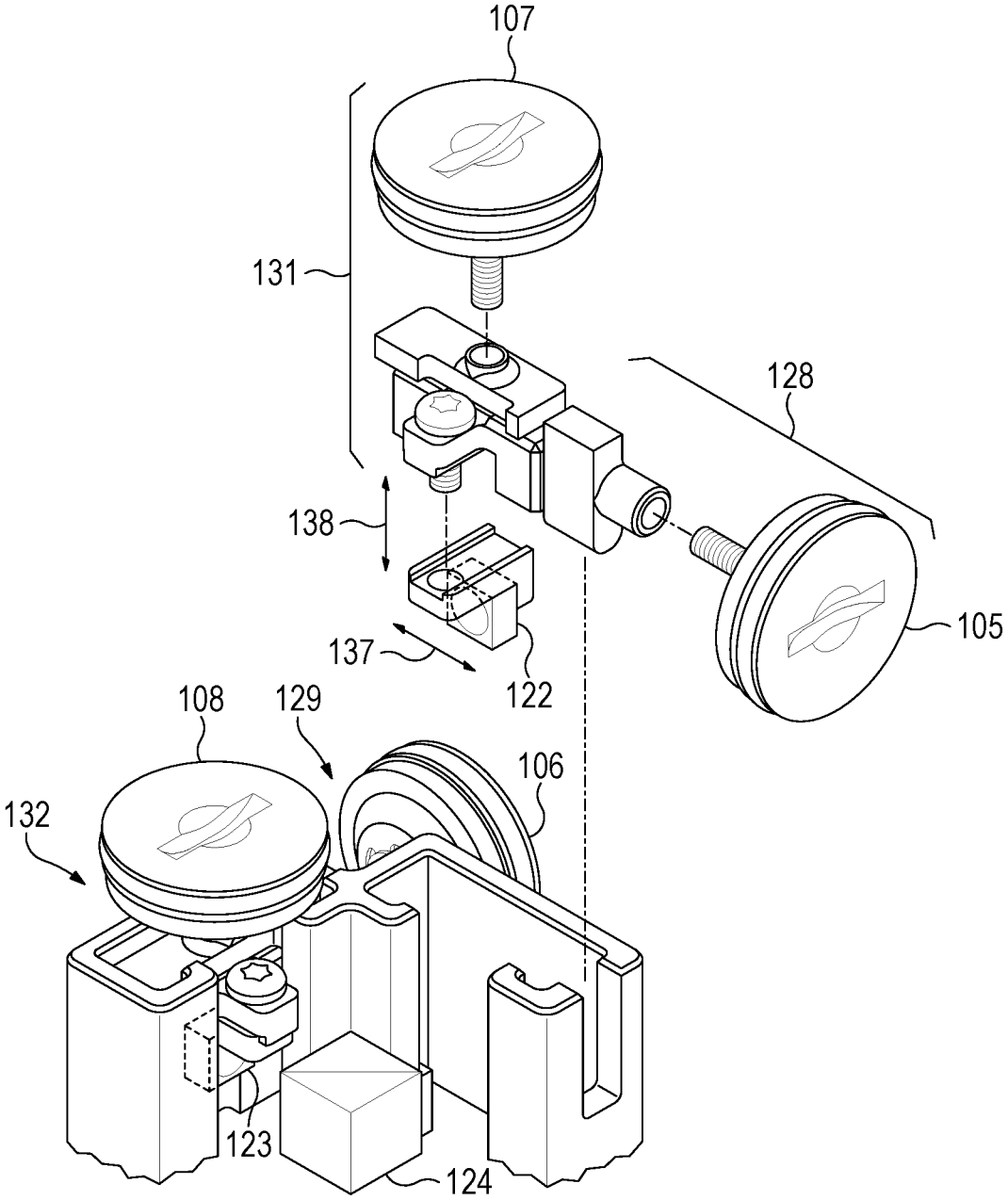
FIG. 7 is a partially exploded view of a portion of the dual-emitter micro-dot sight of FIG. 6.

FIG. 6 is a top, reverse-angle perspective view of a portion of the dual-emitter micro-dot sight of FIG. 3, where some elements have been removed to show other details. FIG. 7 is a partially exploded view of a portion of the dual-emitter micro-dot sight of FIG. 6. As illustrated in FIGS. 6-7, the dual-emitter micro-dot sight 100 may include the first light emitter 122, the second light emitter 123, the beam combiner 124, the windage adjustment mechanism 128 for the first light emitter 122, and the windage adjustment mechanism 129 for the second light emitter 123, each as described above.

The windage adjustment mechanism 128 for the first light emitter 122 may be configured to position the first location 135 (illustrated in FIG. 5B) in a windage adjustment direction 130. As illustrated in FIGS. 6-7, the windage adjustment mechanism 128 for the first light emitter 122 may be configured to move the first light emitter 122 relative to the beam combiner 124. Accordingly, the light from the first light emitter 122 may leave the beam combiner 124 in a direction that is parallel to the direction that the light from the first light emitter 122 left the beam combiner 124 before the adjustment. For the configuration illustrated in FIG. 4, then, the first location 135 (where the light from the first light emitter 122 strikes the collimating lens 125) is moved in the windage adjustment direction 130. Accordingly, the point 114 where the light from the first light emitter 122 strikes the front sight window 109 (that is, the hold-over point for the first light emitter 122) is correspondingly repositioned horizontally to a user looking along the line of sight 113.

The windage adjustment mechanism 128 for the first light emitter 122 may include the first user-adjustable windage dial 105 to effect adjustment of the position of the first light emitter 122 relative to the beam combiner 124. Hence, the user may rotate the first user-adjustable windage dial 105 which, through for example a threaded connection with other components of the windage adjustment mechanism, causes the first light emitter 122 to move in the direction indicated by the arrow 137 in FIG. 7.

The windage adjustment mechanism 129 for the second light emitter 123 may be configured to position the second location 136 (illustrated in FIG. 5B) in the windage adjustment direction 130. As illustrated in FIGS. 6-7, the windage adjustment mechanism 129 for the second light emitter 123 may be configured to move the second light emitter 123 relative to the beam combiner 124. Accordingly, the light from the second light emitter 123 may leave the beam combiner 124 in a direction that is parallel to the direction that the light from the second light emitter 123 left the beam combiner 124 before the adjustment. For the configuration illustrated in FIG. 4, then, the second location 136 (where the light from the second light emitter 123 strikes the collimating lens 125) is moved in the windage adjustment direction 130. Accordingly, the point 115 where the light from the second light emitter 123 strikes the front sight window 109 (that is, the hold-over point for the second light emitter 123) is correspondingly repositioned horizontally to a user looking along the line of sight 113.

The windage adjustment mechanism 129 for the second light emitter 123 may include the second user-adjustable windage dial 106 to effect adjustment of the position of the second light emitter 123 relative to the beam combiner 124. Hence, the user may rotate the second user-adjustable windage dial 106 which, through for example a threaded connection with other components of the windage adjustment mechanism, causes the second light emitter 123 to move in a manner similar to what is described above for the windage adjustment mechanism 128 for the first light emitter 122.

As illustrated in FIGS. 3, 6, and 7, the windage adjustment mechanism 128 for the first light emitter 122 is separate and independent from the windage adjustment mechanism 129 for the second light emitter 123. This allows the hold-over point 114 of the first light emitter 122 to be independently adjusted from the hold-over point 115 of the second light emitter 123. As noted above, this allows each hold-over point to be separately zeroed-in for different projectiles or different ranges, as two examples. This allows the user to rapidly change between different shooting conditions.

The elevation adjustment mechanism 131 for the first light emitter 122 may be configured to position the first location 135 (illustrated in FIG. 5B) in an elevation adjustment direction 133. The elevation adjustment direction 133 is orthogonal to the windage adjustment direction 130. As illustrated in FIGS. 6-7, the elevation adjustment mechanism 131 for the first light emitter 122 may be configured to move the first light emitter 122 relative to the beam combiner 124. Accordingly, the light from the first light emitter 122 may leave the beam combiner 124 in a direction that is parallel to the direction that the light from the first light emitter 122 left the beam combiner 124 before the adjustment. For the configuration illustrated in FIG. 4, then, the first location 135 (where the light from the first light emitter 122 strikes the collimating lens 125) is moved in the elevation adjustment direction 133. Accordingly, the point 114 where the light from the first light emitter 122 strikes the front sight window 109 (that is, the hold-over point for the first light emitter 122) is correspondingly repositioned vertically to a user looking along the line of sight 113.

The elevation adjustment mechanism 131 for the first light emitter 122 may include the first user-adjustable elevation dial 107 to effect adjustment of the position of the first light emitter 122 relative to the beam combiner 124. Hence, the user may rotate the first user-adjustable elevation dial 107 which, through for example a threaded connection with other components of the elevation adjustment mechanism, causes the first light emitter 122 to move in the direction indicated by the arrow 138 in FIG. 7.

The elevation adjustment mechanism 132 for the second light emitter 123 may be configured to position the second location 136 (illustrated in FIG. 5B) in the elevation adjustment direction 133. As illustrated in FIGS. 6-7, the elevation adjustment mechanism 132 for the second light emitter 123 may be configured to move the second light emitter 123 relative to the beam combiner 124. Accordingly, the light from the second light emitter 123 may leave the beam combiner 124 in a direction that is parallel to the direction that the light from the second light emitter 123 left the beam combiner 124 before the adjustment. For the configuration illustrated in FIG. 4, then, the second location 136 (where the light from the second light emitter 123 strikes the collimating lens 125) is moved in the elevation adjustment direction 133. Accordingly, the point 115 where the light from the second light emitter 123 strikes the front sight window 109 (that is, the hold-over point for the second light emitter 123) is correspondingly repositioned vertically to a user looking along the line of sight 113.

The elevation adjustment mechanism 132 for the second light emitter 123 may include the second user-adjustable elevation dial 108 to effect adjustment of a position of the second light emitter 123 relative to the beam combiner 124. Hence, the user may rotate the second user-adjustable elevation dial 108 which, through for example a threaded connection with other components of the elevation adjustment mechanism, causes the second light emitter 123 to move in a manner similar to what is described above for the elevation adjustment mechanism 131 for the first light emitter 122.

As illustrated in FIGS. 3, 6, and 7, the elevation adjustment mechanism 131 for the first light emitter 122 is separate and independent from the elevation adjustment mechanism 132 for the second light emitter 123. Again, this allows the hold-over point of the first light emitter 122 to be independently adjusted from the hold-over point of the second light emitter 123.

In an alternative embodiment, each of the first light emitter 122 and the second light emitter 123 is a multi-pixel array, and the windage adjustment mechanism and the elevation adjustment mechanism may include an electronic controller instead of being fully mechanical as illustrated in FIGS. 6 and 7. In such embodiments, the windage adjustment mechanism and the elevation adjustment mechanism may be accomplished by, for example, illuminating different pixels in the respective multi-pixel array to change the mean point from which a beam of light is emanating from first light emitter 122 or the second light emitter 123.

In an alternative embodiment, the first light emitter 122 and the second light emitter 123 are part of a single, multi-color array. In such embodiments, the beam combiner 124 may not be necessary as the first light emitter 122 and the second light emitter 123 would emanate from a single light emitter, the multi-color array. In such embodiments, the windage adjustment mechanism and the elevation adjustment mechanism may be accomplished by, for example, illuminating different pixels in the multi-color array to change the mean point from which a beam of light is emanating.

FIG. 8 is aside view of the dual-emitter micro-dot sight 100 of FIG. 1 mounted to an example shooting device 116 and illustrating a bore line 121.

Figure 9:
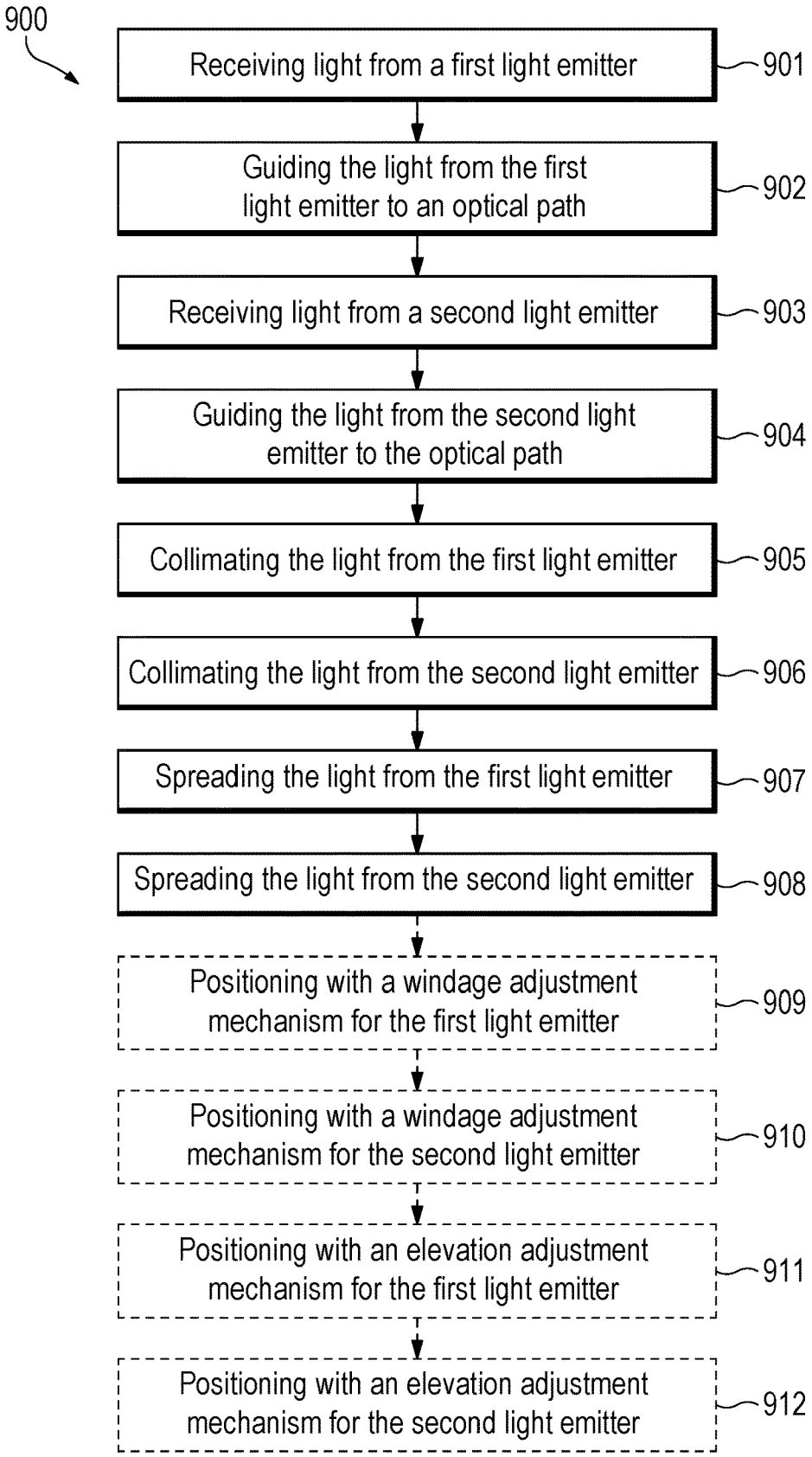
FIG. 9 illustrates an example method of independently positioning each micro dot in a dual-emitter micro-dot sight.

FIG. 9 illustrates an example method of independently positioning each micro dot in a dual-emitter micro-dot sight. The method 900 may include receiving 901, with a beam combiner, light from a first light emitter; guiding 902, by the beam combiner, the light from the first light emitter to an optical path; receiving 903, with the beam combiner, light from a second light emitter; guiding 904, by the beam combiner, the light from the second light emitter to the optical path; collimating 905, with a collimating lens in the optical path, the light from the first light emitter, the light from the first light emitter striking the collimating lens at a first location; collimating 906, with the collimating lens, the light from the second light emitter, the light from the second light emitter striking the collimating lens at a second location; spreading 907, with a diverging lens in the optical path between the beam combiner and the collimating lens, the light from the first light emitter; and spreading 908, with the diverging lens, the light from the second light emitter.

The method may also include positioning 909, with a windage adjustment mechanism for the first light emitter, the first location in a windage adjustment direction; and positioning 910, with a windage adjustment mechanism for the second light emitter, the second location in the windage adjustment direction, the windage adjustment mechanism for the first light emitter being separate and independent from the windage adjustment mechanism for the second light emitter. In such a method, positioning 909 the first location in the windage adjustment direction may include moving the first light emitter relative to the beam combiner, and positioning 910 the second location in the windage adjustment direction may include moving the second light emitter relative to the beam combiner.

The method may also include positioning 911, with an elevation adjustment mechanism for the first light emitter, the first location in an elevation adjustment direction; and positioning 912, with an elevation adjustment mechanism for the second light emitter, the second location in the elevation adjustment direction, the elevation adjustment mechanism for the first light emitter being separate and independent from the elevation adjustment mechanism for the second light emitter. In such a method, positioning 911 the first location in the elevation adjustment direction may include moving the first light emitter relative to the beam combiner, and positioning 912 the second location in the elevation adjustment direction may include moving the second light emitter relative to the beam combiner.

Figure 10:
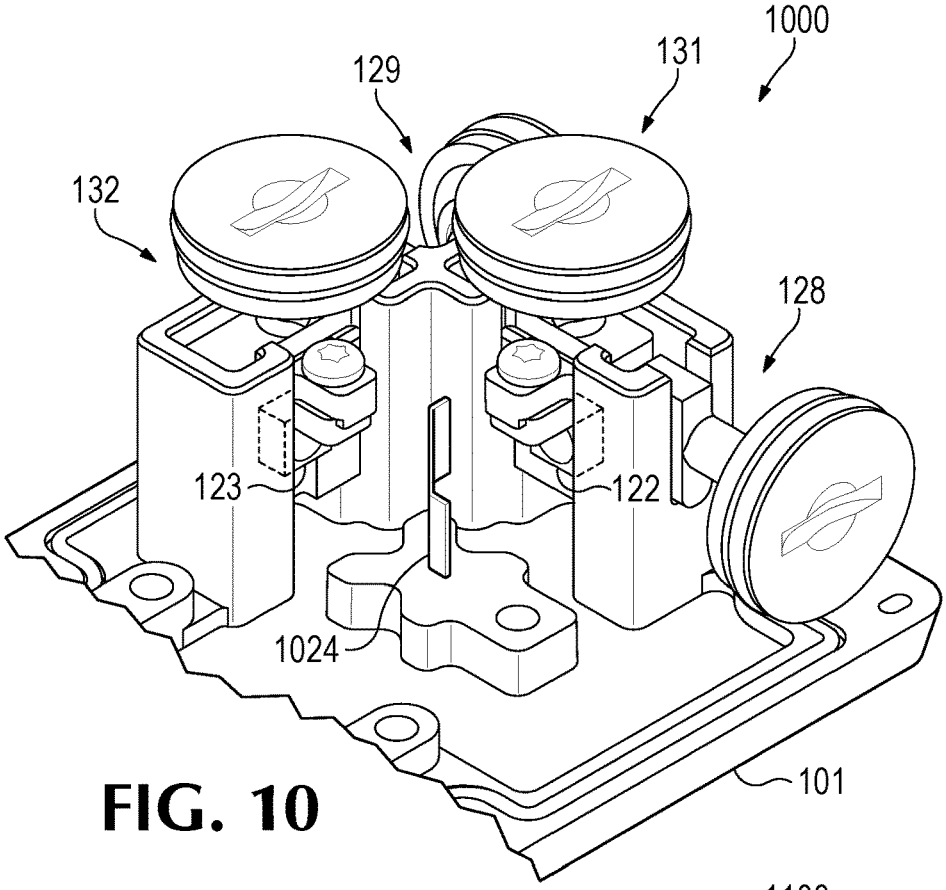
FIG. 10 is a top, reverse-angle perspective view of a portion of the dual-emitter micro-dot sight of FIG. 3, but showing a pellicle beam combiner as the beam combiner.

As noted above, the beam combiner may be a pellicle beam combiner. FIG. 10 is a top, reverse-angle perspective view of a portion of the dual-emitter micro-dot sight of FIG. 3 (similar to the view shown in FIG. 6), but showing a version having a pellicle beam combiner 1024 as the beam combiner 124. As illustrated in FIG. 10, the dual-emitter micro-dot sight 1000 may include the first light emitter 122, the second light emitter 123, the pellicle beam combiner 1024, the windage adjustment mechanism 128 for the first light emitter 122, and the windage adjustment mechanism 129 for the second light emitter 123, the elevation adjustment mechanism 131 for the first light emitter 122, the elevation adjustment mechanism 132 for the second light emitter 123, each as described above.

Figure 11:
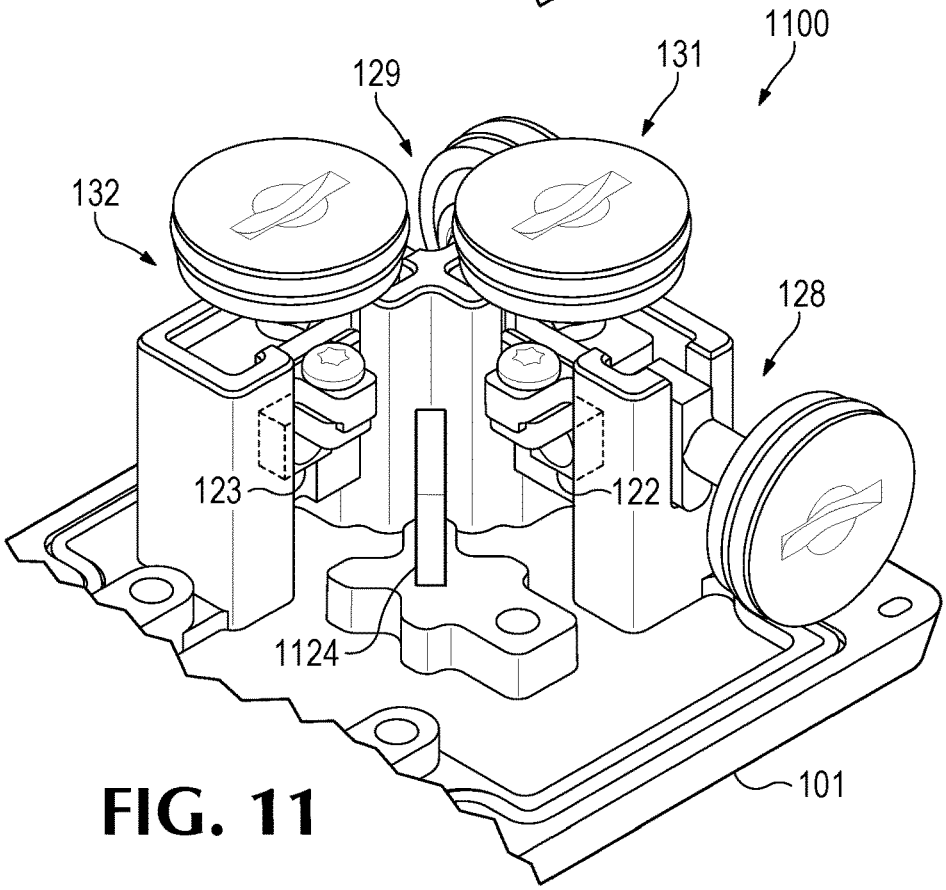
FIG. 11 is a top, reverse-angle perspective view of a portion of the dual-emitter micro-dot sight of FIG. 3, but showing a plate beam combiner as the beam combiner.

As noted above, the beam combiner may be coated window or plate that is at an angle, such as forty-five degrees, to the light coming from the first light emitter 122 or the light coming from the second light emitter 123, or both. FIG. 11 is a top, reverse-angle perspective view of a portion of the dual-emitter micro-dot sight of FIG. 3 (similar to the view shown in FIG. 6), but showing a version having a plate beam combiner 1124 as the beam combiner 124. As illustrated in FIG. 11, the dual-emitter micro-dot sight 1100 may include the first light emitter 122, the second light emitter 123, the plate beam combiner 1124, the windage adjustment mechanism 128 for the first light emitter 122, and the windage adjustment mechanism 129 for the second light emitter 123, the elevation adjustment mechanism 131 for the first light emitter 122, the elevation adjustment mechanism 132 for the second light emitter 123, each as described above.

Figure 12:
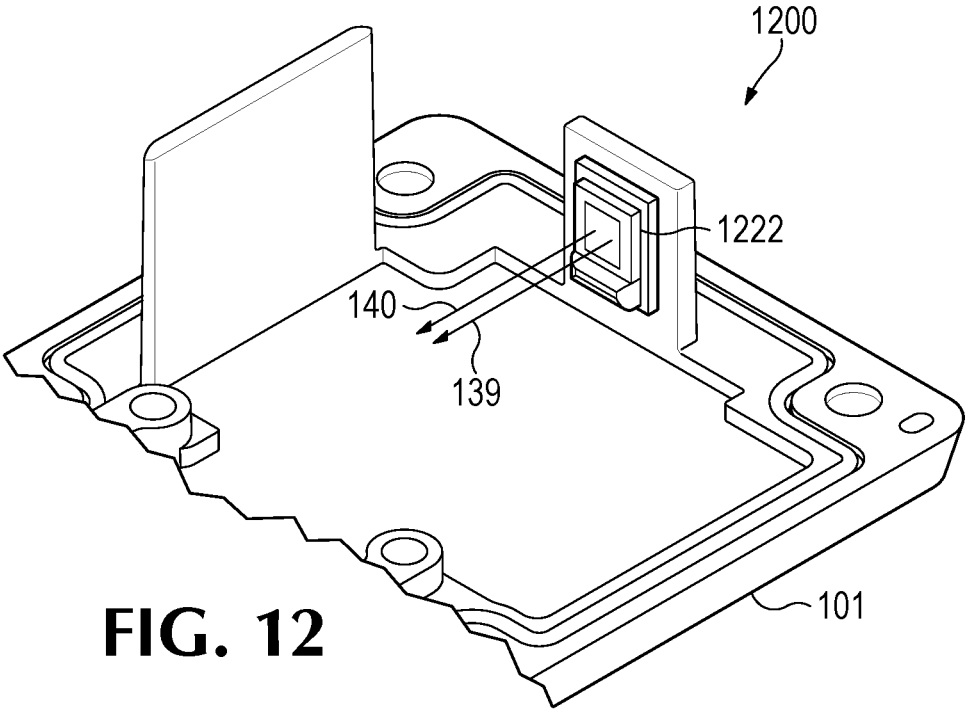
FIG. 12 is a top, reverse-angle perspective view of a portion of the dual-emitter micro-dot sight of FIG. 3, but including a single light emitter instead of the first light emitter and the second light emitter.

FIG. 12 is a top, reverse-angle perspective view of a portion of the dual-emitter micro-dot sight of FIG. 3 (similar to the view shown in FIG. 6), but including a single light emitter 1222 instead of the first light emitter 122 and the second light emitter 123 of FIGS. 4, 6, and 7. As illustrated in FIG. 12, the light emitter 1222 is configured to produce a first beam of light 139 along the optical path 127 and a second beam of light 140 along the optical path 127. Hence, the beam combiner 124 is not required in the embodiment illustrated in FIG. 12. As illustrated, the light emitter 1222 may be a single, multi-color array. The windage adjustment and the elevation adjustment may be accomplished by, for example, illuminating different pixels in the multi-color array to change the mean point from which a beam of light is emanating. The effects of the windage adjustment and the elevation adjustment (in terms of positioning the hold-over points) are as described above in the discussions for FIGS. 6-7.

EXAMPLES

Illustrative examples of the disclosed technologies are provided below. An embodiment of the technologies may include one or more, and any combination of, the examples described below.

Example 1 includes a dual-emitter micro-dot sight comprising: a sight housing configured to mount to a shooting device; a first light emitter coupled to the sight housing; a second light emitter coupled to the sight housing; a beam combiner configured to receive light from the first light emitter and to guide the light from the first light emitter to an optical path, the beam combiner also configured to receive light from the second light emitter and to guide the light from the second light emitter to the optical path; a collimating lens in the optical path, the collimating lens configured to collimate the light from the first light emitter and to collimate the light from the second light emitter, the light from the first light emitter striking the collimating lens at a first location, and the light from the second light emitter striking the collimating lens at a second location; and a diverging lens in the optical path between the beam combiner and the collimating lens, the diverging lens configured to spread the light from the first light emitter and to spread the light from the second light emitter.

Example 2 includes the micro-dot sight of Example 1, further comprising a windage adjustment mechanism for the first light emitter and a windage adjustment mechanism for the second light emitter, the windage adjustment mechanism for the first light emitter being separate and independent from the windage adjustment mechanism for the second light emitter, the windage adjustment mechanism for the first light emitter configured to position the first location in a windage adjustment direction, and the windage adjustment mechanism for the second light emitter configured to position the second location in the windage adjustment direction.

Example 3 includes the micro-dot sight of Example 2, in which the windage adjustment mechanism for the first light emitter is configured to move the first light emitter relative to the beam combiner, and in which the windage adjustment mechanism for the second light emitter is configured to move the second light emitter relative to the beam combiner.

Example 4 includes the micro-dot sight of any of Examples 2-3, the windage adjustment mechanism for the first light emitter further comprising a first user-adjustable windage dial configured to effect adjustment of a position of the first light emitter relative to the beam combiner, and the windage adjustment mechanism for the second light emitter further comprising a second user-adjustable windage dial configured to effect adjustment of a position of the second light emitter relative to the beam combiner.

Example 5 includes the micro-dot sight of any of Examples 1-4, further comprising an elevation adjustment mechanism for the first light emitter and an elevation adjustment mechanism for the second light emitter, the elevation adjustment mechanism for the first light emitter being separate and independent from the elevation adjustment mechanism for the second light emitter, the elevation adjustment mechanism for the first light emitter configured to position the first location in an elevation adjustment direction, and the elevation adjustment mechanism for the second light emitter configured to position the second location in the elevation adjustment direction.

Example 6 includes the micro-dot sight of Example 5, in which the elevation adjustment mechanism for the first light emitter is configured to move the first light emitter relative to the beam combiner, and in which the elevation adjustment mechanism for the second light emitter is configured to move the second light emitter relative to the beam combiner.

Example 7 includes the micro-dot sight of any of Examples 5-6, the elevation adjustment mechanism for the first light emitter further comprising a first user-adjustable elevation dial configured to effect adjustment of a position of the first light emitter relative to the beam combiner, and the elevation adjustment mechanism for the second light emitter further comprising a second user-adjustable elevation dial configured to effect adjustment of a position of the second light emitter relative to the beam combiner.

Example 8 includes the micro-dot sight of any of Examples 1-7, further comprising a substantially flat, front sight window in the optical path, the collimating lens being between the diverging lens and the front sight window in the optical path, the front sight window configured to reflect a first portion of the light from the first light emitter along a line of sight and to reflect a first portion of the light from the second light emitter along the line of sight, the front sight window further configured to refract a second portion of the light from the first light emitter and a second portion of the light from the second light emitter through the front sight window and diverging from the line of sight.

Example 9 includes the micro-dot sight of Example 8, further comprising a substantially flat, rear sight window configured to permit the first portion of the light from the first light emitter to pass through the rear sight window along the line of sight, and to permit the first portion of the light from the second light emitter to pass through the rear sight window along the line of sight.

Example 10 includes the micro-dot sight of Example 9, further comprising a lens housing configured to secure the front sight window and the rear sight window and to prevent light from the first light emitter and the second light emitter from exiting the lens housing other than through the front sight window and the rear sight window.

Example 11 includes the micro-dot sight of any of Examples 8-10, further comprising a shroud configured to absorb substantially all of the second portion of the light from the first light emitter and the second portion of the light from the second light emitter.

Example 12 includes the micro-dot sight of any of Examples 1-11, further comprising a substantially flat, mirrored surface in the optical path, the mirrored surface configured to reflect the light from the first light emitter and the light from the second light emitter.

Example 13 includes the micro-dot sight of Example 12, in which the mirrored surface is between the diverging lens and the collimating lens in the optical path.

Example 14 includes the micro-dot sight of any of Examples 1-13, in which the beam combiner is a cube beam combiner.

Example 15 includes the micro-dot sight of any of Examples 1-13, in which the beam combiner is a plate beam combiner.

Example 16 includes the micro-dot sight of any of Examples 1-13, in which the beam combiner is a pellicle beam combiner.

Example 17 includes a method of independently positioning each micro dot in a dual-emitter micro-dot sight, the method comprising: receiving, with a beam combiner, light from a first light emitter; guiding, by the beam combiner, the light from the first light emitter to an optical path; receiving, with the beam combiner, light from a second light emitter; guiding, by the beam combiner, the light from the second light emitter to the optical path; collimating, with a collimating lens in the optical path, the light from the first light emitter, the light from the first light emitter striking the collimating lens at a first location; collimating, with the collimating lens, the light from the second light emitter, the light from the second light emitter striking the collimating lens at a second location; spreading, with a diverging lens in the optical path between the beam combiner and the collimating lens, the light from the first light emitter; and spreading, with the diverging lens, the light from the second light emitter.

Example 18 includes the method of Example 17, further comprising: positioning, with a windage adjustment mechanism for the first light emitter, the first location in a windage adjustment direction; and positioning, with a windage adjustment mechanism for the second light emitter, the second location in the windage adjustment direction, the windage adjustment mechanism for the first light emitter being separate and independent from the windage adjustment mechanism for the second light emitter.

Example 19 includes the method of Example 18, in which positioning the first location in the windage adjustment direction comprises moving the first light emitter relative to the beam combiner, and in which positioning the second location in the windage adjustment direction comprises moving the second light emitter relative to the beam combiner.

Example 20 includes the method of any of Examples 17-19, further comprising: positioning, with an elevation adjustment mechanism for the first light emitter, the first location in an elevation adjustment direction; and positioning, with an elevation adjustment mechanism for the second light emitter, the second location in the elevation adjustment direction, the elevation adjustment mechanism for the first light emitter being separate and independent from the elevation adjustment mechanism for the second light emitter.

Example 21 includes the method of Example 20, in which positioning the first location in the elevation adjustment direction comprises moving the first light emitter relative to the beam combiner, and in which positioning the second location in the elevation adjustment direction comprises moving the second light emitter relative to the beam combiner.

Example 22 includes the method of any of Examples 20-21, further comprising: positioning, with a windage adjustment mechanism for the first light emitter, the first location in a windage adjustment direction; and positioning, with a windage adjustment mechanism for the second light emitter, the second location in the windage adjustment direction, the windage adjustment mechanism for the first light emitter being separate and independent from the windage adjustment mechanism for the second light emitter, and the windage adjustment direction being orthogonal to the elevation adjustment direction.

Example 23 includes a dual-beam micro-dot sight comprising: a sight housing configured to mount to a shooting device; a light emitter coupled to the sight housing, the light emitter configured to produce a first beam of light along an optical path and a second beam of light along the optical path; a collimating lens in the optical path, the collimating lens configured to collimate the first beam of light from the light emitter and to collimate the second beam of light from the light emitter, the first beam of light from the light emitter striking the collimating lens at a first location, and the second beam of light from the light emitter striking the collimating lens at a second location; a diverging lens in the optical path between the light emitter and the collimating lens, the diverging lens configured to spread the light from the first light emitter and to spread the light from the second light emitter; and a windage adjustment mechanism configured to position the first location in a windage adjustment direction and to position the second location in the windage adjustment direction, the first location being separate and independent of the second location.

Example 24 includes the micro-dot sight of Example 23, further comprising an elevation adjustment mechanism configured to position the first location in an elevation adjustment direction and to position the second location in the elevation adjustment direction, the first location being separate and independent of the second location.

Example 25 includes the micro-dot sight of any of Examples 23-24, further comprising a substantially flat, front sight window in the optical path, the collimating lens being between the diverging lens and the front sight window in the optical path, the front sight window configured to reflect a first portion of the first beam of light from the light emitter along a line of sight and to reflect a first portion of the second beam of light from the light emitter along the line of sight, the front sight window further configured to refract a second portion of the first beam of light from the light emitter and a second portion of the second beam of light from the light emitter through the front sight window and diverging from the line of sight.

Example 26 includes the micro-dot sight of Example 25, further comprising a substantially flat, rear sight window configured to permit the first portion of the first beam of light from the light emitter to pass through the rear sight window along the line of sight, and to permit the first portion of the second beam of light from the light emitter to pass through the rear sight window along the line of sight.

Example 27 includes the micro-dot sight of Example 26, further comprising a lens housing configured to secure the front sight window and the rear sight window and to prevent the first beam of light and the second beam of light from exiting the lens housing other than through the front sight window and the rear sight window.

Example 28 includes the micro-dot sight of any of Examples 25-27, further comprising a shroud configured to absorb substantially all of the second portion of the first beam of light from the light emitter and the second portion of the second beam of light from the light emitter.

Example 29 includes the micro-dot sight of any of Examples 23-28, further comprising a substantially flat, mirrored surface in the optical path, the mirrored surface configured to reflect the first beam of light and the second beam of light.

Example 30 includes the micro-dot sight of Example 29, in which the mirrored surface is between the diverging lens and the collimating lens in the optical path.

Example 31 includes the micro-dot sight of any of Examples 23-30, in which the light emitter comprises a multi-color array.

Embodiments may operate on a particularly created hardware, on firmware, digital signal processors, or on a specially programmed general-purpose computer including a processor operating according to programmed instructions. The terms "controller" or "processor" as used herein are intended to include microprocessors, microcomputers, ASICs, and dedicated hardware controllers. One or more aspects may be embodied in computer-usable data and computer-executable instructions, such as in one or more program modules, executed by one or more computers (including monitoring modules), or other devices. Generally, program modules include routines, programs, objects, components, data structures, etc. that perform particular tasks or implement particular abstract data types when executed by a processor in a computer or other device. The computer executable instructions may be stored on a non-transitory computer readable medium such as a hard disk, optical disk, removable storage media, solid state memory, RAM, etc. As will be appreciated by one of skill in the art, the functionality of the program modules may be combined or distributed as desired in various embodiments. In addition, the functionality may be embodied in whole or in part in firmware or hardware equivalents such as integrated circuits, field programmable gate arrays (FPGA), and the like. Particular data structures may be used to more effectively implement one or more aspects of the disclosed systems and methods, and such data structures are contemplated within the scope of computer executable instructions and computer-usable data described herein.

The previously described versions of the disclosed subject matter have many advantages that were either described or would be apparent to a person of ordinary skill. Even so, all of these advantages or features are not required in all versions of the disclosed apparatus, systems, or methods.

Additionally, this written description makes reference to particular features. It is to be understood that the disclosure in this specification includes all possible combinations of those particular features. For example, where a particular feature is disclosed in the context of a particular aspect or embodiment, that feature can also be used, to the extent possible, in the context of other aspects and embodiments.

Also, when reference is made in this application to a method having two or more defined steps or operations, the defined steps or operations can be carried out in any order or simultaneously, unless the context excludes those possibilities.

Furthermore, the term "comprises" and its grammatical equivalents are used in this application to mean that other components, features, steps, processes, operations, etc. are optionally present. For example, an article "comprising" or "which comprises" components A, B, and C can contain only components A, B, and C, or it can contain components A, B, and C along with one or more other components.

Also, directions such as "vertical," "horizontal," "right," and "left" are used for convenience and in reference to the views provided in figures. But the dual-emitter micro-dot sight may have a number of orientations in actual use. Thus, a feature that is vertical, horizontal, to the right, or to the left in the figures may not have that same orientation or direction in actual use.

Although specific embodiments have been illustrated and described for purposes of illustration, it will be understood that various modifications may be made without departing from the spirit and scope of the disclosure. Accordingly, the invention should not be limited except as by the appended claims.

The invention claimed is:

1. A dual-emitter micro-dot sight comprising:

a sight housing configured to mount to a shooting device;

a first light emitter coupled to the sight housing;

a second light emitter coupled to the sight housing;

a beam combiner configured to receive light from the first light emitter and to guide the light from the first light emitter to an optical path, the beam combiner also configured to receive light from the second light emitter and to guide the light from the second light emitter to the optical path;

a collimating lens in the optical path, the collimating lens configured to collimate the light from the first light emitter and to collimate the light from the second light emitter, the light from the first light emitter striking the collimating lens at a first location, and the light from the second light emitter striking the collimating lens at a second location; and a diverging lens in the optical path between the beam combiner and the collimating lens, the diverging lens configured to spread the light from the first light emitter and to spread the light from the second light emitter.

2. The micro-dot sight of claim 1, further comprising a windage adjustment mechanism for the first light emitter and a windage adjustment mechanism for the second light emitter, the windage adjustment mechanism for the first light emitter being separate and independent from the windage adjustment mechanism for the second light emitter, the windage adjustment mechanism for the first light emitter configured to position the first location in a windage adjustment direction, and the windage adjustment mechanism for the second light emitter configured to position the second location in the windage adjustment direction.

3. The micro-dot sight of claim 2, in which the windage adjustment mechanism for the first light emitter is configured to move the first light emitter relative to the beam combiner, and in which the windage adjustment mechanism for the second light emitter is configured to move the second light emitter relative to the beam combiner.

4. The micro-dot sight of claim 2, the windage adjustment mechanism for the first light emitter further comprising a first user-adjustable windage dial configured to effect adjustment of a position of the first light emitter relative to the beam combiner, and the windage adjustment mechanism for the second light emitter further comprising a second user-adjustable windage dial configured to effect adjustment of a position of the second light emitter relative to the beam combiner.

5. The micro-dot sight of claim 1, further comprising an elevation adjustment mechanism for the first light emitter and an elevation adjustment mechanism for the second light emitter, the elevation adjustment mechanism for the first light emitter being separate and independent from the elevation adjustment mechanism for the second light emitter, the elevation adjustment mechanism for the first light emitter configured to position the first location in an elevation adjustment direction, and the elevation adjustment mechanism for the second light emitter configured to position the second location in the elevation adjustment direction.

6. The micro-dot sight of claim 5, in which the elevation adjustment mechanism for the first light emitter is configured to move the first light emitter relative to the beam combiner, and in which the elevation adjustment mechanism for the second light emitter is configured to move the second light emitter relative to the beam combiner.

7. The micro-dot sight of claim 5, the elevation adjustment mechanism for the first light emitter further comprising a first user-adjustable elevation dial configured to effect adjustment of a position of the first light emitter relative to the beam combiner, and the elevation adjustment mechanism for the second light emitter further comprising a second user-adjustable elevation dial configured to effect adjustment of a position of the second light emitter relative to the beam combiner.

8. The micro-dot sight of claim 1, further comprising a substantially flat, front sight window in the optical path, the collimating lens being between the diverging lens and the front sight window in the optical path, the front sight window configured to reflect a first portion of the light from the first light emitter along a line of sight and to reflect a first portion of the light from the second light emitter along the line of sight, the front sight window further configured to refract a second portion of the light from the first light emitter and a second portion of the light from the second light emitter through the front sight window and diverging from the line of sight.

9. The micro-dot sight of claim 8, further comprising a substantially flat, rear sight window configured to permit the first portion of the light from the first light emitter to pass through the rear sight window along the line of sight, and to permit the first portion of the light from the second light emitter to pass through the rear sight window along the line of sight.

10. The micro-dot sight of claim 9, further comprising a lens housing configured to secure the front sight window and the rear sight window and to prevent light from the first light emitter and the second light emitter from exiting the lens housing other than through the front sight window and the rear sight window.

11. The micro-dot sight of claim 8, further comprising a shroud configured to absorb substantially all of the second portion of the light from the first light emitter and the second portion of the light from the second light emitter.

12. The micro-dot sight of claim 1, further comprising a substantially flat, mirrored surface in the optical path, the mirrored surface configured to reflect the light from the first light emitter and the light from the second light emitter.

13. The micro-dot sight of claim 12, in which the mirrored surface is between the diverging lens and the collimating lens in the optical path.

14. The micro-dot sight of claim 1, in which the beam combiner is a cube beam combiner.

15. The micro-dot sight of claim 1, in which the beam combiner is a plate beam combiner.

16. The micro-dot sight of claim 1, in which the beam combiner is a pellicle beam combiner.

17. A method of independently positioning each micro dot in a dual-emitter micro-dot sight, the method comprising:

receiving, with a beam combiner, light from a first light emitter;

guiding, by the beam combiner, the light from the first light emitter to an optical path;

receiving, with the beam combiner, light from a second light emitter;

guiding, by the beam combiner, the light from the second light emitter to the optical path;

collimating, with a collimating lens in the optical path, the light from the first light emitter, the light from the first light emitter striking the collimating lens at a first location;

collimating, with the collimating lens, the light from the second light emitter, the light from the second light emitter striking the collimating lens at a second location;

spreading, with a diverging lens in the optical path between the beam combiner and the collimating lens, the light from the first light emitter; and spreading, with the diverging lens, the light from the second light emitter.

18. The method of claim 17, further comprising:

positioning, with a windage adjustment mechanism for the first light emitter, the first location in a windage adjustment direction; and positioning, with a windage adjustment mechanism for the second light emitter, the second location in the windage adjustment direction, the windage adjustment mechanism for the first light emitter being separate and independent from the windage adjustment mechanism for the second light emitter.

19. The method of claim 18, in which positioning the first location in the windage adjustment direction comprises moving the first light emitter relative to the beam combiner, and in which positioning the second location in the windage adjustment direction comprises moving the second light emitter relative to the beam combiner.

20. The method of claim 17, further comprising:

positioning, with an elevation adjustment mechanism for the first light emitter, the first location in an elevation adjustment direction; and positioning, with an elevation adjustment mechanism for the second light emitter, the second location in the elevation adjustment direction, the elevation adjustment mechanism for the first light emitter being separate and independent from the elevation adjustment mechanism for the second light emitter.

21. The method of claim 20, in which positioning the first location in the elevation adjustment direction comprises moving the first light emitter relative to the beam combiner, and in which positioning the second location in the elevation adjustment direction comprises moving the second light emitter relative to the beam combiner.

22. The method of claim 20, further comprising:

positioning, with a windage adjustment mechanism for the first light emitter, the first location in a windage adjustment direction; and positioning, with a windage adjustment mechanism for the second light emitter, the second location in the windage adjustment direction, the windage adjustment mechanism for the first light emitter being separate and independent from the windage adjustment mechanism for the second light emitter, and the windage adjustment direction being orthogonal to the elevation adjustment direction.

23. A dual-beam micro-dot sight comprising:

a light emitter coupled to a sight housing, the light emitter configured to produce a first beam of light along an optical path and a second beam of light along the optical path;

a collimating lens in the optical path, the collimating lens configured to collimate the first beam of light from the light emitter and to collimate the second beam of light from the light emitter, the first beam of light from the light emitter striking the collimating lens at a first location, and the second beam of light from the light emitter striking the collimating lens at a second location;

a diverging lens in the optical path between the light emitter and the collimating lens, the diverging lens configured to spread the light from the first light emitter and to spread the light from the second light emitter; and a windage adjustment mechanism configured to position the first location in a windage adjustment direction and to position the second location in the windage adjustment direction, the first location being separate and independent of the second location.

24. The micro-dot sight of claim 23, further comprising an elevation adjustment mechanism configured to position the first location in an elevation adjustment direction and to position the second location in the elevation adjustment direction, the first location being separate and independent of the second location.

25. The micro-dot sight of claim 23, further comprising a substantially flat, front sight window in the optical path, the collimating lens being between the diverging lens and the front sight window in the optical path, the front sight window configured to reflect a first portion of the first beam of light from the light emitter along a line of sight and to reflect a first portion of the second beam of light from the light emitter along the line of sight, the front sight window further configured to refract a second portion of the first beam of light from the light emitter and a second portion of the second beam of light from the light emitter through the front sight window and diverging from the line of sight.

26. The micro-dot sight of claim 25, further comprising a substantially flat, rear sight window configured to permit the first portion of the first beam of light from the light emitter to pass through the rear sight window along the line of sight, and to permit the first portion of the second beam of light from the light emitter to pass through the rear sight window along the line of sight.

27. The micro-dot sight of claim 26, further comprising a lens housing configured to secure the front sight window and the rear sight window and to prevent the first beam of light and the second beam of light from exiting the lens housing other than through the front sight window and the rear sight window.

28. The micro-dot sight of claim 25, further comprising a shroud configured to absorb substantially all of the second portion of the first beam of light from the light emitter and the second portion of the second beam of light from the light emitter.

29. The micro-dot sight of claim 23, further comprising a substantially flat, mirrored surface in the optical path, the mirrored surface configured to reflect the first beam of light and the second beam of light.

30. The micro-dot sight of claim 29, in which the mirrored surface is between the diverging lens and the collimating lens in the optical path.

31. The micro-dot sight of claim 23, in which the light emitter comprises a multi-color array.

* * * * *